United States Patent [19]

Sloan

[11] Patent Number: 4,486,197

[45] Date of Patent: Dec. 4, 1984

[54] FIBROUS PRODUCT CONTAINING VISCOSE

[75] Inventor: Frederick R. W. Sloan, London, England

[73] Assignee: Lintrend Licensing Company Limited, London, England

[21] Appl. No.: 354,086

[22] PCT Filed: Jul. 1, 1981

[86] PCT No.: PCT/GB81/00120

§ 371 Date: Feb. 3, 1982

§ 102(e) Date: Feb. 3, 1982

[87] PCT Pub. No.: WO82/00164

PCT Pub. Date: Jan. 21, 1982

Related U.S. Application Data

[63] Continuation-in-part of Ser. No. 237,874, Feb. 25, 1981, abandoned.

[30] Foreign Application Priority Data

Jun. 3, 1981 [GB] United Kingdom ..... 8021888
Jul. 3, 1981 [GB] United Kingdom ..... 8021889

[51] Int. Cl.[3] ..... D06M 1/24; D06M 1/22; D06M 1/02; D06P 1/56

[52] U.S. Cl. ..... 8/493; 8/125; 8/184; 8/185; 8/186

[58] Field of Search ..... 8/125, 493, 184, 185, 8/186

[56] References Cited

U.S. PATENT DOCUMENTS

| | | | |
|---|---|---|---|
| 2,988,416 | 6/1961 | Wood | 8/115.6 |
| 3,090,666 | 5/1963 | Jones | 8/493 |
| 3,457,025 | 7/1969 | Barber et al. | 8/125 |
| 3,480,382 | 11/1969 | Sloan et al. | 8/125 |
| 3,901,014 | 8/1975 | Hiroi et al. | 8/125 |

FOREIGN PATENT DOCUMENTS

| | | | |
|---|---|---|---|
| 727888 | 4/1955 | United Kingdom | 8/125 |
| 846287 | 8/1960 | United Kingdom . | |
| 877582 | 9/1961 | United Kingdom . | |

OTHER PUBLICATIONS

Reinhardt et al., American Dyestuff Reporter, vol. 47, Nov. 3, 1958, pp. 758–764.

Plotz, Jour. of the Textile Inst. Proceedings, vol. 53P, Jan. 1962, pp. 521–561.

Mark, H. ed., Chemical *Aftertreatment of Textiles,* Wiley Interscience, (1972), pp. 350–351.

*Primary Examiner*—Maria Parrish Tungol
*Attorney, Agent, or Firm*—Lawrence Rosen

[57] ABSTRACT

A fabric containing viscose fibres is subjected to cross-linking followed by mercerization and then generally further cross-linking. It is possible to obtain products having good dyeability soft handle and good wet and dry crease resistance.

21 Claims, No Drawings

FIBROUS PRODUCT CONTAINING VISCOSE

The U.S. application designated in this application is a continuation-in-part of U.S. application Ser. No. 237,874 Feb. 25, 1981 abandoned, the entire disclosure of which is completely incorporated herein by reference.

It is common practice to impart easy care properties (for instance wet and/or dry crease resistance), to fabrics formed of cotton fibres or blends containing cotton fibres with, for instance, polyester fibres. Such methods involve the use of inter alia textile resins or cellulosic cross-linking agents. In PCT Patent Specification No. WO80/00463 a process is described for imparting easy care properties to linen products, optionally mixed with voscose.

It would be very desirable to be able to make a wide range of easy care products containing viscose but it has not previously been possible to achieve this by any convenient commercial methods.

Although viscose has certain inherent advantages as a fabric fibre it also suffers from serious disadvantages. Thus an untreated viscose fabric will not have satisfactory easy care properties, and for instance will readily crease. In an attempt at improving the easy care properties and in order to minimise loss of strength when wet and in order to minimise shrinkage it is common to apply a textile resin. However the amount that is applied has to be such that the resultant fabric loses some of the desirable properties of viscose and instead becomes rather harsh, especially when wet, and the easy care properties are still not entirely satisfactory.

Another disadvantage of viscose is that it has very poor dye receptivity, probably because when the viscose fibre is contacted with a dye the fibre swells and so reduces the capillary action that is necessary for reception of dye. Accordingly it is not possible to dye viscose fabrics by conventional continuous dyeing techniques.

Viscose is soluble in alkali and since many of the conventional treatments for giving easy care properties require alkali treatment it would be expected that they would result in destruction or damage of the fibres.

It has been alleged, in German Patent Specification No. 1173428, that good dry and wet resistance and soft hand on fabrics of native or regenerated cellulose can be obtained by treating the fabrics with a compound that evolves formaldehyde when heated followed by treatment with a solution containing 2 to 6% alkali and a glycol softener. In practice however this method does not give very satisfactory results when applied to viscose containing fabrics.

In British Patent Specification No. 1034453 a process is described of forming a bulked fabric by cross-linking viscose rayon fibre and then using this fibre to form a fabric which is then impregnated with caustic soda and then pulled back to full width. It is also mentioned that the cross-linking can be conducted on the fabric itself, but this is not exemplified and in fact it seems probable that the desired bulk effect would not be achieved if the cross-linking was conducted on the fabric instead of the free fibre.

The process has not been adopted commercially for the treatment of fabric and, prior to the present invention, there has been no known commercial process for making a fabric including substantial amounts of viscose fibres and that has an acceptable combination of dry and wet crease resistance and softness.

Although cellulosic fabrics are considered by many users to possess properties that make them preferable to synthetic fabrics for wear in hot humid conditions a disadvantage of many such fabrics is that they become less soft with increasing moisture. Accordingly although they may be very comfortable under moderate conditions of temperature and humidity at high humidity the softness of the fabric has been reduced, thus making the humidity more noticeable to the wearer.

It has been our object to devise a method of forming a fabric including viscose fibres and which has a good combination of wet crease resistance and softness and preferably also dry crease resistance.

In the invention a fabric that includes viscose fibres, generally in an amount of at least 30% by weight of the fibres in the fabric, is impregnated with an initial cross-linking agent and an activator for this, the agent is cured, the fabric is then mercerised while allowing shrinkage of viscose fibres, and the viscose fibres in the fabric are allowed to remain permanently shrunk by at least 5%.

The fabric may be formed solely of viscose fibres or it may be formed of viscose fibres together with other fibres, generally in an amount of not more than 50% by weight. These other fibres may be synthetic fibres but preferably are natural fibres, most preferably cotton or linen. Preferred fabrics contain from 50 to 90% viscose and 10 to 40% cotton or linen.

When the fabric is formed of a blend of viscose fibres and other fibres the fabric may be formed of yarns consisting of viscose and yarns consisting of the other fibres but more usually is formed of yarns each comprising a blend of viscose and the other fibres. Suitable methods of forming appropriate linen blends are known and reference may be made to, for instance, PCT Publication No. WO80/00463.

Any material capable of cross-linking the cellulosic molecules of the viscose fibres to the desired extent may be used. Formaldehyde donors may be used but preferably the initial cross-linking is achieved by impregnation with a conventional cellulosic cross-linking agent and an activator.

This cross-linking agent is a bi- or poly- functional reagent that will react with, and thus bridge and cross-link, hydroxy groups in the cellulose.

Typical bi- or poly-functional compounds that serve as cross-linking agents are alcohols, triazones, aldehydes such as glyoxal, and methylol urea derivatives that will react with cellulose in preference to undergoing self polymerisation, such as dimethylol cyclic methylene or ethylene or other alkylene urea.

Activators suitable for use with such cross-linking agents are well known and are generally referred to as catalysts or curing agents. They generally are acidic, for instance inorganic or organic acids such as citric or succinic acid or acidic salts such as magnesium chloride. Preferably, instead of using phase separation catalysts such as these, non-phase separation curing agents (for instance a triethylene glycol citric acid or other citric acid water soluble polyester) are used.

The cross-linking agent and activator are generally applied from an aqueous solution containing, for instance 10 to 30% of the cross-linking agent and 0.5 to 5% of the activator. The pick up may be, for example, 50 to 80% by weight of the solution.

Curing of the cross-linking system may be achieved by, for instance, heating at 120° to 220° C. for 0.5 to 5 minutes.

Known mercerising reagents and temperatures may be used for the mercerising step in the invention. Suitable reagents are strong ammonia, cuprammonium solutions and other alkaline solutions generally of alkaline earth metal hydroxides, for instance calcium hydroxide or alkali metal hydroxides, generally sodium hydroxide, the latter being preferred. Typical concentrations of caustic soda or other reagent are 10 to 40%, especially 20 to 30%, by weight giving about 60°Tw. Treatment preferably comprises impregnation e.g. by immersion in a 3 bowl trough mangle at a temperature below 30° C., preferably 0° to 10° C. Impregnation of caustic soda between 0°–10° C. is the preferred method. This is obtained by refrigerating the caustic soda and circulating the liquor in the trough for the impregnating mangle. The contact with alkali is generally relatively quick, for instance ½ to 30 minutes and usually 1 to 10 minutes, whereupon the fibrous material is washed with water to eliminate the alkali or other mercerising reagent.

It seems that the success of the invention resides partly upon the fact that the initial cross-linking provides an appropriate degree of restraint but that the viscose swells and the fibres permanently shrink as a result of the mercerisation. Without the cross-linking step, the fibres would dissolve during the mercerisation. It seems that the cross-linking provides restraint such that unique changes occur in the structure of the fibres during the mercerisation. It can be considered that the fibres pass through a thermoplastic state. Whatever the precise mechanism, it is a fact that appropriate combination of cross-linking followed by mercerisation and permanent shrinkage results in a surprising improvement in the wet crease resistance of the fibres.

In order to obtain good results a significant amount of swelling must occur. However if there is insufficient cross-linking the degree of swelling will be so much that, after drying the fabric, the fibres will be very brittle and hard. If the degree of cross-linking is too much then the fabric becomes very rigid and inadequate swelling occurs. However higher than normal degrees of cross-linking can be tolerated if the cross-linking agent is one that is degraded by the mercerising conditions, since the mercerisation will then result initially in reduction of the degree of cross-linking and then in the desired swelling and shrinkage.

The preferred cross-linking agents are cyclic alkylene urea derivatives, for instance dihydroxy dimethylol cyclic methylene or ethylene urea and it is convenient to express the degree of cross-linking by reference to the add-on of such cross-linking agents to the fabric. In general the degree of cross-linking should be below 20% add-on since satisfactory results are not usually obtainable with higher values, unless the cross-linking agent decomposes partially during mercerisation. Generally the cross-linking should be above 3% add-on, since with lower amounts the degree of restraint is so small that very high shrinkage will occur. Low add-ons such as 3 or 4% are particularly desirable when the fabric has a wide warp spacing since it is then possible to make a stretch fabric. For more usual purposes however suitable add-ons are from 5 to 20%, especially 5 to 15%. Best results are generally obtained with add-ons of from 8 to 13%, most preferably about 10%. When a different type of cross-linking agent is used then different, but equivalent, amounts of add-on will be required. For instance if the cross-linking agent is formaldehyde, either introduced as such or liberated from a formaldehyde donor, then the equivalent amounts of add-on will be very much less, due to the lower molecular weight of formaldehyde.

For any particular degree of cross-linking there will be a potential shrinkage obtainable by the fabric during prolonged mercerisation and preferably the conditions of mercerisation are such that the weft viscose fibres have a final shrinkage of at least 50% and preferably at least 75% of their potential shrinkage and the warp fibres have a shrinkage of at least 25% and preferably at least 33% of their potential shrinkage. For instance the duration of the mercerisation should be selected to be sufficiently long to achieve the desired degree of shrinkage. With the lower degrees of cross-linking (for instance equivalent to 15% add-on or less) it is usually sufficient for mercerisation to be conducted for not more than 10 or 15 minutes but with higher degrees of cross-linking, for instance 15 to 20% add-on, longer periods up to 30 minutes or even more may be required.

The mercerisation may be conducted while no tension is applied in the warp or weft, for instance while the fabric is allowed to remain in a relaxed state in a trough, and the fabric may then be pulled lengthwise (i.e. in the warp direction) to the next processing stage (for instance rinsing and drying). This pulling will result in some warp tension and some reduction in the warp shrinkage, which previously will preferably have been the full shrinkage attainable. The weft shrinkage, which also will preferably have been the maximum shrinkage attainable, may be allowed to remain unchanged or may be reduced slightly as a result of stentering the fabric out to a controlled width, which still results in a final shrinkage of at least 5%. Another way of achieving the mercerisation is to conduct the mercerisation while restricting the fabric against some shrinkage in the warp direction and optionallly also in the weft direction, for instance by pulling it on a stenter. The tension by which it is held must be such as to permit the desired final shrinkage to occur.

Preferably the shrinkage that remains in the weft fibres is at least 10%, generally 10 to 25% and most preferably 15 to 20. The shrinkage that remains in the warp may be similar but lower shrinkages can be tolerated and may be up to, for instance, 15%, usually 5 to 12% and most preferably 8 to 10%.

With most fabric constructions the degree of shrinkage can be observed simply by measuring the reduction in the width and length of the fabric. However with very tight weaves the weave itself may prevent reduction in the width or length of the fabric even though the fibres within the fabric will have shrunk. Accordingly it should be understood that the percentage shrinkage values that are quoted are normally the values obtainable by measuring the width and length of the fabric but that if this is a very tight weave then they are the values that would be obtainable by a more loosely woven fabric treated under the same conditions.

A fabric consisting or containing a large proportion of viscose fibres will generally have a wet crease angle of about 90°, and this angle is not substantially changed by the cross-linking. However the wet crease angle after the mercerisation and permanent shrinkage in the invention can easily be increased to 120° or more, for instance as much as 140°. Accordingly the mercerised and shrunk products of the invention have good wet crease resistance.

The dry crease resistance of the initial fabric is generally around 100° and this may increase slightly, for instance to 110°, by the cross-linking. However the mercerisation will generally result in a reduction of this, for instance back to a value of about 100°. The loss in dry crease angle is generally less with phase separation catalysts than with non-phase separation curing agents as discussed above.

The wet and dry crease angles mentioned herein are the angles measured by the Shirley Crease Angle test. Higher values indicate better properties.

Although fabrics obtainable by cross-linking and mercerisation as described above have good handle and wet crease resistance, and are thus suitable for use as, for instance, table cloths or upholstery fabrics, it is desirable to improve their dry crease resistance and it has surprisingly been found that this can be achieved without damaging the other properties of the fabric by applying a textile resin or by further cross-linking the mercerised product. Suitable textile resins are known for the treatment of cotton and may be applied in a similar manner to obtain an add-on of 2 to 10%, preferably 3 to 7% and most preferably around 5%.

Preferably however the dry crease resistance is improved by subjecting the fabric to a final cross-linking, generally using about half the amount of cross-linking agent used for the initial cross-linking, so that the solids add-on is preferably about 2 to 10%, e.g. 3 to 7% most preferably around 5%. This reduced add-on may be achieved using more dilute solutions of the cross-linking agent. The cross-linking materials and process may be selected from the process and materials discussed above for use in the initial stage. Typically the final dry crease angle will be 110° to 140° C. Best results are generally obtained using a non-phase separation curing agent, for instance a polyester as mentioned above, and this has the particular advantage that it gives a fabric having better abrasion resistance.

Fabrics made by the invention have a soft handle and good wet crease resistance, and optionally also good dry crease resistance. A particular advantage of the invention is that the fabrics also can have a unique property in that the fabric becomes softer with increasing humidity.

Accordingly a separate aspect of the invention resides in a novel fabric that contains viscose fibres and which is characterised in that the fibres have been cross-linked and the fabric becomes softer with increasing humidity. Another advantage of the invention is that it results in the viscose fibres being much more easily dyeable than normal. Thus viscose fabrics processed in accordance with the invention can be subjected to continuous dyeing techniques which normally are suitable for use on, for instance, cotton but not viscose. Typically the process of the invention results in it being possible to obtain the same depth of shade but using only half the amount of dyestuff, The following are examples of the invention.

EXAMPLE 1

A fabric may be formed of yarn formed of a blend of viscose and 25% linen or cotton fibres. The fabric may be impregnated while held on a stenter with 20% w/v solution of dihydroxy dimethylol cyclic ethylene urea activated with 2% w/v triethylene glycol citric acid polyester. The acid value of the polyester may be about 190 and the pH of the impregnating solution should be at least 3.2. The wet pick up of the fabric may be about 70% and the dry add-on about 10% by weight. The fabric may then be dried on the stenter, heated to a temperature of about 170° C. for 2 minutes, washed and dried.

The fabric may then be passed into and pulled out of a bath of caustic soda solution of about 30% and may be drawn out of the bath and partially pulled back to width on a stenter while being rinsed with water. The duration of contact between the caustic soda solution and the viscose fibres may be about 1 to 2 minutes. While the fabric is passing through the bath and before it is rinsed with water (thus terminating the mercerisation) the tension applied in the length is sufficient to permit the fibres to shrink, and the length of the fabric to reduce, by about 10%. During the passage through the bath no tension is applied in the weft direction, with the result that the weft fibres shrink, and the weft dimension reduces, by about 25%. During the rinsing weft tension is applied on the stenter to an amount such that the final shrinkage is about 20%, based on the original width of the fabric.

The washed fabric may then be dried. It will have very high wet crease resistance and may be dyed by continuous dyeing techniques and has a soft handle that becomes softer with increasing humidity.

EXAMPLE 2

The process of Example 1 may be repeated using magnesium chloride as the activator instead of the described polyester. The final washed fabric will be found to have wet crease resistance as good as in Example 1 and dry crease resistance rather better than in Example 1.

EXAMPLE 3

The process of Example 1 may be repeated but using higher concentrations of cross-linking agent, with the result that the add-on is about 15% by weight. The mercerisation may then be conducted by impregnating the fabric, after cross-linking, with 30% caustic soda solution at about 5° C. and then leaving the impregnated fabric in a J box for about 15 minutes before partially pulling it back to width and rinsing and drying it.

EXAMPLE 4

The process of Example 1 or Example 2 may be repeated except that after washing the mercerised fabric the fabric may then be impregnated with a 10% w/v solution of dihydroxy dimethyl cyclic ethylene urea activated with 1% w/v triethylene glycol citric acid polyester. The impregnation may be conducted while the mercerised fabric is held on a stenter and it may be then dried, heated to about 170° C. for two minutes washed and dried. The final product will have greatly improved dry crease resistance, while retaining the wet crease resistance of Examples 1 or 2. The add-on is 5%.

EXAMPLE 5

The process of Example 1 or Example 2 may be repeated except that after washing the mercerised fabric the fabric may be impregnated with a solution of urea formaldehyde resin, having a molar ratio urea:formaldehyde of 1:4 and ammonium dihydrogen phosphate activator at a concentration to give a solids add-on of about 5% and an acidity to give a pH on the fabric of about 3.2. The resin may then be cured by heating, followed by washing and drying. Again the product has very good wet crease and dry crease resistance and softness.

The fabrics treated and shrunk in the process of the invention may be used to make shaped goods, e.g. clothes, by conventional methods, while in their permanent shrunk state.

I claim:

1. A process of improving the wet and dry crease resistance and softness of a fabric comprising viscose fibers comprising impregnating said fabric with a polyfunctional cross-linking agent that will react with and bridge between hydroxy groups in the cellulose molecules in the viscose fibers, and an activator for the cross-linking agent, heating said impregnated fabric to effect cross-linking, mercerizing said fabric while allowing shrinkage of said viscose fibers and maintaining said shrunk viscose fibers in said fabric whereby said fabric remains shrunk by a final shrinkage of at least 5% and then impregnating said viscose shrunk fabric with a curing system selected from cross-linking agents and textile resins together with an activator for the curing system, and heating said impregnated shrunk fabric to cure the curing system.

2. A process according to claim 1 which the final shrinkage of the weft dimension of said fabric is from 10 to 30% and the final shrinkage of the warp dimension of said fabric is from 5 to 30% and the solids add-on of the cross-linking agent is from 3 to 20% by weight.

3. A process according to claim 1 in which the final shrinkage of the weft dimension is from 15 to 25% and the final shrinkage of the warp dimension is from 7 to 12% and the solids add-on of the cross-linking agent is from 3 to 13% by weight.

4. A process according to claim 1 in which said cross-linking agent is a acyclic alkylene urea cross-linking agent.

5. A process according to claim 1 in which said cross-linking agent is a dihydroxy dimethylol cyclic alkylene urea cross-linking agent.

6. A process according to claim 1 in which said activator for the cross-linking agent is a non-phase separation curing agent.

7. A process according to claim 1 in which said activator for the cross-linking agent is a citric acid water soluble polyester.

8. A process according to claim 1 in which said activator for the cross-linking agent is triethylene glycol citric acid.

9. A process according to claim 1 in which the mercerization is conducted using 10 to 40% sodium hydroxide solution.

10. A process according to claim 1 in which the mercerization is conducted while no tension is applied in the warp and then pulling said fabric in the warp direction to give said final shrinkage.

11. A process according to claim 1 in which said mercerization is conducted while no tension is applied in the weft.

12. A process according to claim 11 further comprising stretching said fabric in the weft direction to give said final shrinkage.

13. A process according to claim 1 in which the mercerization is conducted while applying low tension in the warp to give the said final shrinkage.

14. A process according to claim 13 in which the mercerization is conducted while applying low tension in the weft to give said final shrinkage.

15. A process according to claim 1 in which the fabric is a woven fabric comprising a blend of viscose fibers and fibers comprising linen and cotton fibers.

16. A process according to claim 1 in which the solids add-on of the said curing system is from 3 to 7%.

17. A process according to claim 16 in which said curing system is a dihydroxy dimethylol cyclic alkylene urea cross-linking agent.

18. A process according to claim 1 in which said activator is a water-soluble polyester formed with citric acid and a glycol.

19. A process according to claim 1 further comprising subjecting said fabric to continuous dyeing.

20. A process according to claim 1 wherein the fabric comprises 50–100% viscose and 0–50% synthetic or natural fibres.

21. A process according to claim 1 wherein the fabric comprises 50–90% viscose and 10–50% cotton or linen.

* * * * *